United States Patent [19]

Riess

[11] 3,968,522

[45] July 13, 1976

[54] GOLF BALL POCKET AND IMPROVED GOLF GARMENT

[76] Inventor: Karl Riess, 800 N. Mariposa Ave., Los Angeles, Calif. 90029

[22] Filed: Sept. 12, 1975

[21] Appl. No.: 612,848

[52] U.S. Cl. ..... 2/250; 224/5 D

[51] Int. Cl.[2] ..... A41D 27/20

[58] Field of Search ..... 2/250, 247, 252, 94; 224/5 C, 5 D

[56] References Cited

UNITED STATES PATENTS

| | | | |
|---|---|---|---|
| 1,421,955 | 7/1922 | Kemp | 2/247 UX |
| 1,970,110 | 8/1934 | Vaccaro | 2/247 |
| 2,461,390 | 2/1949 | Montague | 2/250 |
| 2,537,701 | 1/1951 | Previdi | 2/250 X |
| 2,558,382 | 6/1951 | Previdi | 2/250 X |
| 2,593,218 | 4/1952 | Swain | 2/250 X |
| 3,320,620 | 5/1967 | Weidler et al. | 2/250 |
| 3,777,933 | 12/1973 | Joliot | 224/5 D X |
| 3,840,901 | 10/1974 | Eyster | 2/247 |

*Primary Examiner*—Alfred R. Guest
*Attorney, Agent, or Firm*—Henry M. Bissell

[57] ABSTRACT

The improved golf ball pocket of the invention comprises a flexible sheet of fabric or the like shaped to define an open-bottomed and open-topped, closed-sided golf ball-receiving tube, preferably for stocking a plurality of golf balls in a vertical orientation. Elastic means secured to the sheet releasably close the open bottom and open top of the tube. A separate golf tee supporting area may be provided alongside of the tube in the sheet, and elastic means may define a plurality of the shank-receiving loops.

The ball tube preferably includes golf ball ports through which golf balls in the tube can be viewed for inspection of their condition and for their individual selection and through which they can be manipulated, if desired, to aid their release from the tube. The pocket may be separately connectable to or form part of the exterior of the golf garment of the invention.

18 Claims, 4 Drawing Figures

GOLF BALL POCKET AND IMPROVED GOLF GARMENT

BACKGROUND OF THE INVENTION

1. Field of the Invention

The present invention generally relates to sports accessories and more particularly to golf ball and tee carrying means.

2. Description of the Prior Art

Golfers usually carry a number of golf balls and tees with them during their rounds of golf in order to replace those balls and tees which become lost or damaged. Moreover, in the case of the golf balls, golfers prefer to select the proper ball for the circumstances. Thus, when the golfer is on the putting green, a new or almost new ball is usually used, so that it does not have any surface imperfection which could affect its roll and the ability of the golfer to sink the putt. For long shots with woods, thin-covered golf balls which will carry farther than balls with thicker covers are preferred. With such shots the risk of damaging the ball cover is less than when irons are used. Conversely, thicker-covered golf balls are preferred for iron shots by essentially all golfers except experts.

The golfer usually has golf balls and tees stowed away in zippered pockets of his or her golf bag which also contains the golf clubs. The golf bag is carried over the shoulder or on powered or unpowered golf carts. Golf bags are usually large and clumsy and the balls and tees placed therein are often difficult to remove therefrom. Moreover, when a given golf ball is needed for a particular shot, it is often hard to find among so many others in the golf bag. Such bag may be at some distance from the golfer, so that reaching the ball to be used would be inconvenient.

Accordingly, separate golf ball and tee holders carried by the golfer have been provided in the past to overcome such difficulties. Such holders usually are releasably affixed through loops to the golfer's trouser belt. Thus, such holders are not well adapted for use by female golfers. Moreover, they comprise blind pouches carrying golf balls in side-by-side relation around the belt and thus are relatively bulky. Most such holders are also unattractive and, moreover, they do not facilitate the locating of a particular golf ball for a particular purpose. Such devices have met with little commercial success in large part they afford little advantage over merely stowing the golf balls in the golf bag.

Accordingly, there is a need for improved inexpensive and efficient means for carrying golf balls and tees. Such means should also be able to carry a plurality of golf balls in a compact attractive manner and should enable the golfer to check easily on the condition of the golf balls.

SUMMARY OF THE INVENTION

The foregoing needs have been satisfied by the improved golf ball pocket and garment of the present invention. They are substantially as set forth in the Abstract above. Thus, the golf ball pocket comprises a flexible sheet, such as fabric, a portion of which is shaped to define a golf ball-enclosing tube adapted to carry a plurality of golf balls in stacked, preferably vertical, alignment. Elastic means releasably close the open top and bottom of the tube and ports are provided through the tube to view the golf balls therein in order to aid in their selection and to check their condition.

Such an arrangement imparts an attractive appearance to the pocket. Such pocket may also include a tee-supporting area, preferably on the side of the tube, with elastic means defining loops which grip the tee shanks. The pocket may be separately attachable to the exterior of a golf garment or may be an integral part thereof. The garment of the invention includes the improved golf and tee pocket as an integral part thereof. Further aspects of the invention are set forth in the following detailed description and accompanying drawings.

BRIEF DESCRIPTION OF THE DRAWING

A better understanding of the present invention may be had from a consideration of the following detailed description, taken in conjunction with the accompanying drawings, in which.

DESCRIPTION OF THE PREFERRED EMBODIMENT

FIGS. 1–3

Figure 1:
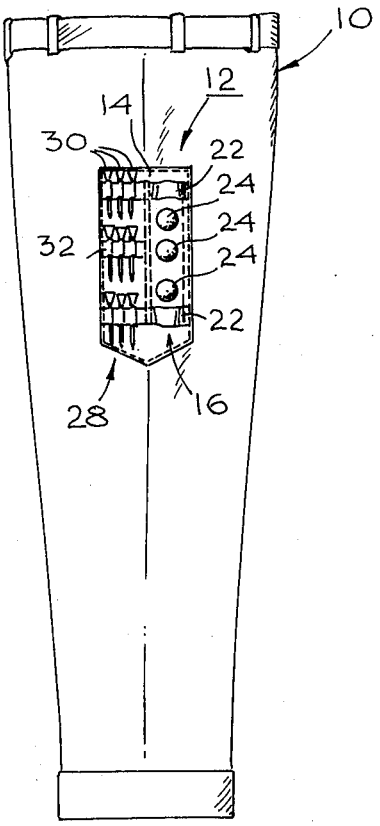
FIG. 1 is a schematic side elevation of a preferred embodiment of the improved golf garment of the present invention, with a preferred embodiment of the improved golf pocket of the invention shown in schematic top plan view.

As shown schematically in side elevation in FIG. 1 of the drawings, the improved golf garment of the invention may comprise golf trousers 10 which include an exterior golf pocket 12 of improved design, construction and appearance. It will be understood that in place of trousers 10 any other suitable golf garment can be used. For example, the garment can be a pair of golf shorts or a golf skirt or even a golf shirt or sweater. Preferably, however, it is a fabric garment worn on the lower part of the body, such as shorts, slacks or skirt and may be of any suitable material and construction provided it contains the improved golf pocket 12 of the invention.

Figure 2:
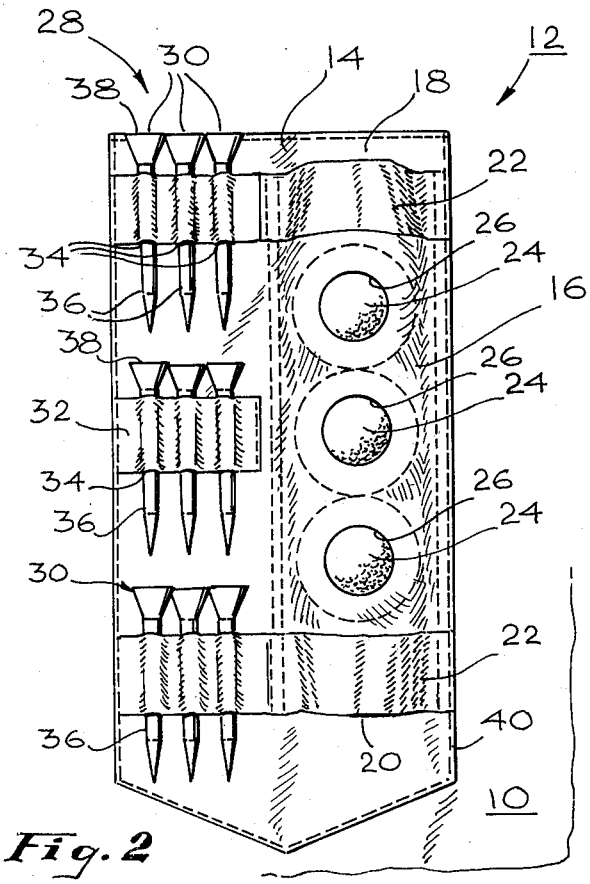
FIG. 2 is an enlarged schematic top plan view of the improved golf pocket in place on the garment of FIG. 1.
Figure 3:
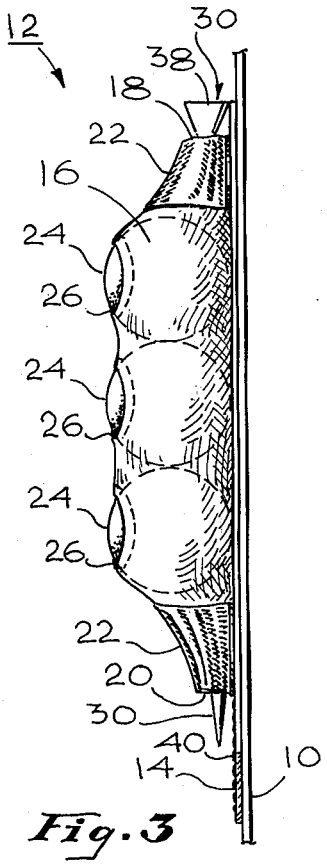
FIG. 3 is a schematic side elevation of the improved golf pocket shown in FIG. 2.

Pocket 12, as shown in detail in schematic FIGS. 2 and 3, comprises a flexible sheet 14 of extended surface area, which sheet 14 may be fabric or the like. Sheet 14 can be of any overall shape, such as the chevron shape shown, and is particularly shaped to provide a golf-ball receiving, preferably vertically oriented, tube 16 therein which has an open top 18 and open bottom 20, each opening being covered by elastic means in the form of a separate elastic band 22 to releasably close top 18 and bottom 20. Bands 22 can be of rubberized stretch fabric or the like. Tube 16 is long enough to releasably contain a plurality (in this instance three) of stacked golf balls 24 which can be removed from tube 16 by squeezing each ball 24 through top 18 or bottom 20, passing under the corresponding band 22.

It will be understood that tube 16 can be made longer or shorter to accommodate more or fewer balls 24 than those shown in FIGS. 1, 2 and 3. Moreover, tube 16 preferably contains a plurality of ports 26 through which balls 24 in tube 16 can be viewed to determine which ball 24 is which and what its condition is, i.e. whether it need be cleaned, replaced or the like. Thus, a separate putting ball, a separate ball to be used with woods and a separate ball to be used with irons can all be carried in pocket 12 and can be easily identified through ports 26 and retrieved from pocket 12 through top 18 or bottom 20. Ports 26 in tube 16 are open circular apertures but could be of other configuration, such as square, diamond shaped, and/or covered with transparent material such as clear plastic or the like (polyethene, etc.), if desired. Moreover, ports 26 lend an attractive decorative appearance to pocket 12, the white color of balls 24 contrasting with the color and shape of sheet 14 and of bands 22, as desired.

Preferably, as shown in FIGS. 1–3, pocket 12 includes a golf tee-supporting area 28 in which means, preferably elastic means, are provided for releasably holding a plurality of golf tees 30. Such means may comprise elastic bands 22 extending over into area 28 from tube 16 and/or may comprise separate bands, such as elastic band 32, as shown in FIG. 2. Bands 22 and 32 in area 28 are secured, as by stitching (not shown), to the face of sheet 14 so as to provide a plurality of narrow loops 34 through which the shanks 36 of tees 30 are fitted and are releasably positively gripped to keep them from jiggling loose. Loops 34 are too narrow to allow the passage of tee heads 38 therethrough. Accordingly tees 30 are easily, securely, conveniently and decoratively supported in area 28 for carrying on pocket 12 and for easy removal therefrom. Such an arrangement increases the attractive and novel appearance and utility of pocket 12.

It will be noted that pocket 12 is compact, permits a plurality of balls 24 to be carried with a minimum of trouble and is of novel appearance. With balls 24 arranged in stacked relation, they provide minimal interference with the golfer's movements and are all essentially in one location, in contrast to being strung out along a belt line, as with prior ball carriers. Moreover, pocket 12 can be easily attached to or form an integral part of the exterior of grament 10, as by stitching 40 or the like along the periphery of sheet 14, as shown in FIGS 2 and 3.

Figure 4:
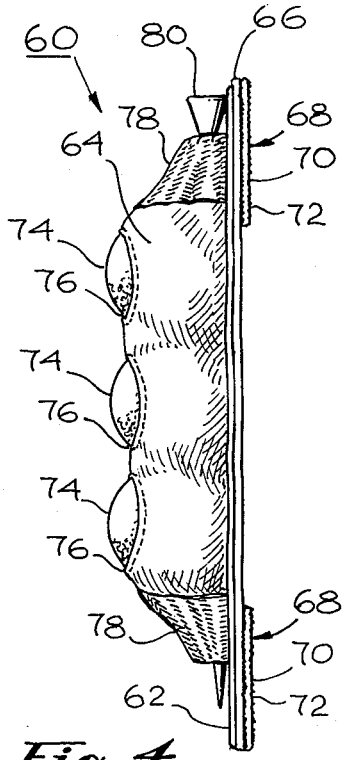
FIG. 4 is a schematic side elevation of a modified embodiment of the improved golf pocket of the invention.

An alternative embodiment of the improved golf pocket of the invention is set forth in schematic side elevation in FIG. 4. Thus, a pocket 60 is shown which is substantially identical in shape, design, utility and construction to pocket 12, except that it includes, in addition to a front sheet 62 from which a golf ball tube 64 (identical to tube 16) is formed, a flat flexible backing sheet 66 of like size to which front sheet 62 is secured, as by stitching or the like (not shown). To the back of backing sheet 66 is also secured means for connecting pocket 60 to the exterior of a golf garment, such means including a pair of strips 68 containing pressure sensitive releasable adhesive, such as cloth 70 covered with tacky cohesive rubber 72 or the like on both sides thereof. Thus, pocket 60 can be attached in any desired location on a golf garment and can be removed, if desired, when the garment is to be cleaned, etc. When so attached, golf balls 74 in pocket tube 64 are viewable through ports 76 and are retrievable from tube 64 through elastic bands or closures 78 on opposite ends of tube 64. Tees 80 are supported by elastic bands 78 similarly to the manner in which tees 30 are supported by bands 22 (see FIG. 2). Pocket 60 has the advantages of pocket 12.

Thus, an improved golf ball pocket, which may also carry golf tees, is provided which incorporates in a simple, inexpensive way, improved portability, compactness and utility. Such pocket is highly attractive and can be incorporated in golf garb to form the novel garment of the invention. Through the use of the novel pocket, golf balls and tees are more easily accessible for selection and use, thus adding to the enjoyment of golf. Further advantages are as set forth in the foregoing.

Various modifications, alterations, changes and additions can be made in the improved golf ball and tee pocket and improved golf garment of the invention, their components and parameters. All such modifications, alterations, changes and additions as are within the scope of the appended claims form part of the present invention.

What is claimed is:

1. An improved golf ball pocket, said pocket being adapted for securing to the exterior of a garment, said pocket comprising, in combination.

a. a flexible front sheet of extended surface area shaped to define an open-bottomed and open-topped closed sided golf ball-receiving tube; and b. elastic means secured to one side of said front sheet and releasably closing said open top and said open bottom of said tube.

2. The improved golf ball pocket of claim 1 wherein said sheet includes a golf-tee supporting area and wherein said elastic means defines a plurality of golf tee-shank-receiving means in said tee-supporting area.

3. The improved golf ball and tee pocket of claim 1 wherein said pocket includes a separate flexible backing sheet secured to said front sheet to define said tube therewith.

4. The improved golf ball pocket of claim 3 wherein said pocket includes means or attaching said backing sheet to the exterior of a garment.

5. The improved golf ball pocket of claim 1 wherein separate elastic means comprising elastic bands releasably close said open top and said open bottom of said tube.

6. The improved golf ball pocket of claim 5 wherein said tube is adapted to receive a plurality of golf balls in vertical array.

7. The improved golf ball pocket of claim 3 wherein said front sheet is vertically elongated with said golf tee-supporting area bordering the side of said tube.

8. The improved golf ball pocket of claim 1 wherein said tube defines a plurality of ports for viewing golf balls when in their vertical area in said tube.

9. The improved golf ball pocket of claim 8 wherein said ports are spaced apart and comprise apertures in the portion of said sheet defining said tube at locations along said tube corresponding to golf ball positions when in said tube.

10. The improved golf ball pocket of claim 7 wherein a plurality of elastic bands define said tee-shank-receiving means in said tee-supporting area.

11. The improved golf ball and tee pocket of claim 1 wherein said sheet comprises fabric.

12. An improved golf garment, said garment comprising, in combination:

a. clothing defining golfing garb; and b. an improved golf ball pocket connected to the exterior of said garb as an integral part thereof, said pocket including:

1. A flexible sheet of extended surface area shaped to define an open-bottomed and open-topped closed-sided golf ball-receiving tube, and d
2. elastic means secured to one side of said sheet and releasably closing said open top and said open bottom of said tube.

13. The improved garb of claim 12 wherein said sheet includes a golf tee-supporting area and wherein said elastic means defines a plurality of golf tee shank-receiving means in said tee-supporting area.

14. The improved golf garment of claim 12 wherein the elastic means comprise separate elastic bands releasably closing said open top and said open bottom of said tube.

15. The improved golf garment of claim 13 wherein said tube is adapted to receive a plurality of golf balls in vertical array and wherein said sheet is vertically elongated with said golf tee-supporting area bordering said tube.

16. The improved golf garment of claim 15 wherein said golf tee-supporting area borders the side of said tube and wherein said tube defines a plurality of golf ball-viewing ports.

17. The improved golf garment of claim 16 wherein said ports comprise apertures in the area of said sheet defining said tube at spaced locations along said tube corresponding to golf ball positions when in said tube.

18. The improved golf garment of claim 17 wherein said pocket comprises fabric and wherein a plurality of elastic bands define said tee-shank-receiving means in said tee-supporting area.

* * * * *